US005139530A

United States Patent [19]

Blanchard et al.

[11] Patent Number: 5,139,530

[45] Date of Patent: Aug. 18, 1992

[54] POST-CROSSLINKING TREATMENT OF CELLULOSIC MATERIALS FOR ENHANCED DYEABILITY

[75] Inventors: Eugene J. Blanchard, Metairie; Robert M. Reinhardt, New Orleans, both of La.

[73] Assignee: The United States of America as represented by the Secretary of Agriculture, Washington, D.C.

[21] Appl. No.: 645,439

[22] Filed: Jan. 24, 1991

[51] Int. Cl.[5] ..... D06M 11/38

[52] U.S. Cl. ..... 8/125; 8/194; 8/195; 8/543; 8/680; 8/673; 8/918

[58] Field of Search ..... 8/196, 188, 181, 125, 8/195, 543, 680, 673

[56] References Cited

U.S. PATENT DOCUMENTS

| | | | |
|---|---|---|---|
| 3,480,382 | 11/1969 | Sloan | 8/125 |
| 3,542,503 | 11/1970 | Kulman et al. | 8/125 |
| 3,567,362 | 3/1971 | Jung et al. | 8/125 |
| 4,780,102 | 10/1988 | Harper, Jr. | 8/196 |

OTHER PUBLICATIONS

A. G. Pierce, "Retention of Swelling Ability in Cotton Cross-Linked with High-Temperature Curing" Textile Research Journal, vol. 34, No. 6, pp. 552-558, Jun., 1964.

*Primary Examiner*—Prince Willis, Jr.
*Assistant Examiner*—John F. McNally
*Attorney, Agent, or Firm*—M. Howard Silverstein; John D. Fado; Joseph A. Lipovsky

[57] ABSTRACT

Anionically dyeable smooth-dry crosslinked cellulosic materials are produced by treatment of methylolamide crosslinked cellulosic materials with an alkali swelling agent such as sodium hydroxide prior to dyeing. Attainable color strength is dependent upon both the concentration and the contact time of the alkali swelling agent with the cellulosic material. Types of usable anionic dyes include acid, direct, and reactive dyes. The cellulose-containing material may be in the form of fibers, threads, linters, roving, fabrics, yarns, slivers and paper.

29 Claims, No Drawings

POST-CROSSLINKING TREATMENT OF CELLULOSIC MATERIALS FOR ENHANCED DYEABILITY

BACKGROUND OF THE INVENTION

1. Field of the Invention

This invention relates to dyeable smooth-dry crosslinked cellulosic material and its creation by means of contacting the crosslinked material with an alkali swelling agent prior to dyeing.

2. Description of the Prior Art

Cellulosic fabrics do not possess smooth-dry (durable press or wash wear) performance or dimensional stability. In order to acquire these properties, cellulosic fabric requires a chemical finish. The chemical agents used in these processes are known as crosslinking agents. Examples of some agents are dimethylol dihydroxyethyleneurea (DMDHEU) or dimethylol propylcarbamate (DMPC).

While treatment of cellulosic fabric with a crosslinking agent does make the fabric smooth drying and dimensionally stable, it reduces the dyeability of cellulose by causing the cellulosic fibers to become fixed in a collapsed state upon their being cured at elevated temperature. Therefore, modern textile processes require fabric to be dyed first and then finished for smooth dry performance. When fabrics are crosslinked with common and readily available agents, such as DMDHEU or DMPC, subsequent dyeing has been unsuccessful.

Previously, crosslinking agents and reactive additives have been utilized as a route to dyeable crosslinked fabrics. U.S. Pat. No. 3,788,804 teaches the use of crosslinking agents and hydroxycarboxylic acids to form crosslinked fabrics with acidic grafts, and dyeing the fabrics with basic dyes. Also, U.S. Pat. No. 3,807,946 teaches the use of crosslinking agents and a reactive additive such as triethanolamine to form a crosslinked fabric with a grafted amine and dyeing such with an acid dye. U.S. Pat. No. 3,853,459 utilizes a treatment of crosslinking agent and polymer to form a durable-press fabric with a polymeric treatment and dyeing with a disperse dyestuff.

These patents have in common the teaching of dyeing modified cellulosic fabrics with non-cellulosic dyestuffs. Consequently, the performance of these dyes on a cellulosic substrate is not as good as cellulose dyed with normal dyestuffs such as direct or reactive dyes which are usually used on cellulosic fabrics.

U.S. Pat. 4,780,102 teaches improved dyeing properties for cotton finished with both a crosslinking agent and polyethylene glycol. Fabric treated according to this method can be dyed with dyes normally used with untreated cotton, such as direct and reactive dyes, but color strength is adversely affected with the increasing molecular weight of the dye. Usually, the color strength of the finished-crosslinked material is not as good as that of the untreated cotton. Also, such fabric cannot be dyed with acid dyes nor with reactive dyes under acidic conditions.

Pierce et al. [Tex. Res. J. 34:552–558 (1964)] have shown that glycol ethers in the finishing formulation are capable of propping open the cellulosic fiber during the curing reaction so that crosslinking occurs with the cotton in a swollen rather than collapsed state. To applicants' knowledge there are however no teachings in the literature on the alkali treatment of cotton for improving dyeing characteristics after finishing fabric with a crosslinking agent.

SUMMARY OF THE INVENTION

This invention describes the production of crosslinked cellulosic materials that have smooth drying properties as well as enhanced affinity for anionic dyestuffs. The method involves treating cellulosic material with an alkali swelling agent after it has been crosslinked with a methylolamide crosslinking agent in the presence of an amine or quaternary ammonium compound. After the cellulosic material has been exposed to the alkali solution for a period of time sufficient to cause the desired change in structure, the material is then rinsed, neutralized of excess alkali, and optionally dried prior to its being dyed. The treated material can then be dyed with anionic dyestuffs to produce colored, wrinkle-resistant cellulosic material.

Therefore, it is an object of this invention to produce cellulosic materials which are readily dyeable with anionic dyes under acidic conditions, which cellulosic materials previously have been crosslinked with a methylolamide crosslinking agent in the presence of an amine or a quaternary ammonium compound.

Another object of the invention is to perform the dyeing step under neutral to acidic conditions, thereby eliminating the need for other bases, added salts such as carbonates, and standard salts normally used in cellulosic fabric dyeing procedures.

Another object of the invention is to enable the dyeing of crosslinked cellulosic materials with high molecular-weight anionic dyes.

Still another object of the invention is to provide a wide variety of multicolored effects by combining treated and untreated cellulosic yarns in cotton fabrics.

Other objects and advantages of the invention will become readily apparent from the ensuing description.

DETAILED DESCRIPTION OF THE INVENTION

The present invention is based upon the discovery that the dyeability of smooth-dry crosslinked cellulose with regard to anionic dyestuffs is markedly enhanced over that previously achieved in the prior art. This is accomplished by contacting the crosslinked cellulosic material with an aqueous alkali solution for a period of time sufficient to swell the crosslinked cellulosic fibers and create an interstitial spacing of sufficient size to allow larger dye molecules to interact with the cellulose.

This altered structure is amenable to dyeing with agents including anionic dyestuffs. The most marked improvement over the prior art is noted with anionic dyes having molecular weights from about 800 to about 1,400. These dyes are already conventional in the textile industry as dyestuffs for non-crosslinked cellulose.

The process to produce the crosslinked cellulosic material utilized in the instant invention may be accomplished by treating the cellulosic material with an aqueous formulation comprising a methylolamide crosslinking agent, a catalyst, and one or more of a hydroxyalkylamine salt or a hydroxyalkyl quaternary ammonium salt; with subsequent drying and curing.

The present invention is applicable to fibrous cellulosic material including cotton, flax, jute, hemp, ramie and regenerated unsubstituted wood celluloses such as rayon. Combinations of said cellulosics and combinations of said cellulosics with other fibers such as polyesters, nylons, acrylics, and the like also can be treated. The disclosed process may be applied to fibrous cellulosic material in the form of woven and non-woven textiles such as yarns and woven or knit fabrics, and to fibers, threads, linters, roving, slivers or paper. The disclosed process is most advantageous with material containing about 50%-100% cellulose. The preferred material is cotton.

A wide variety of compounds may be used as the methylolamide crosslinking agent of the invention. Useful compounds include methylolated ureas, cyclic ureas, urons, triazones, carbamates, and triazines, as well as alkylated and hydroxyalkylated derivatives thereof. A non-limitative list of typical agents includes dimethylol urea, partially methylolated urea, methylated urea-formaldehyde, dimethylol ethyleneurea, dimethylol dihydroxyethyleneurea, dimethylol propyleneurea, dimethylol substituted propyleneurea, tri- and tetramethylol acetyleneurea, bis(methoxymethyl)uron, dimethylol methyl carbamate, dimethylol propyl carbamate, methylolated melamines, methyoxymethylolated melamines, and the like. The especially preferred crosslinking agent is dimethylol dihydroxyethyleneurea (DMDHEU). The amount of crosslinking agent used is from about 3% to about 15% by weight of the formulation, with the preferred amount ranging from about 4% to about 8%. Should too little crosslinking agent be used, a product possessing the enhanced dyeing properties of the instant invention will not be acquired.

A reaction catalyst, which aids in the crosslinking of the cellulosic substrate with the methylolamide compound is present in the formulation in the amount of about 10% to about 60% based on the weight of the methylolamide crosslinking agent; a preferred amount is from about 20% to about 40%. Catalysts which can be used include: various mineral acids, organic acids, salts of strong acids, ammonium salts, alkanolamine salts, metallic salts; and combinations of the above. Useable compounds of such catalyst classes include but are not limited to the following:

a. Mineral acids such as hydrochloric acid, sulfuric acid, nitric acid, phosphoric acid and boric acid.

b. Organic acids such as oxalic acid, tartaric acid, citric acid, malic acid, glycolic acid, methoxyacetic acid, cloroacetic acid, lactic acid, 3-hydroxybutyric acid, methanesulfonic acid, ethanesulfonic acid, hydroxymethanesulfonic acid, benzenesulfonic acid, p-toluenesulfonic acid, cyclopentanetetracarboxylic acid, butanetetracarboxylic acid, tetrahydrofurantetracarboxylic acid, nitrilotriacetic acid, and ethylenediaminetetraacetic acid.

c. Salts of strong acids such as sodium bisulfate, sodium dihydrogen phosphate and disodium hydrogen phosphate.

d. Ammonium salts such as ammonium chloride, ammonium nitrate, ammonium sulfate, ammonium bisulfate, ammonium dihydrogen phosphate and diammonium hydrogen phosphate.

e. Alkanolamine salts such as the hydrochloride, nitrate, sulfate, phosphate and sulfamate salts of 2-amino-2-methyl-1-propanol, tris(hydroxymethyl)aminomethane and 2-amino-2-ethyl-1, 3-propanediol.

f. Metal salts such as aluminum chlorhydroxide, aluminum chloride, aluminum nitrate, aluminum sulfate, magnesium chloride, magnesium nitrate, magnesium sulfate, zinc chloride, zinc nitrate and zinc sulfate.

Preferred catalysts include the halide and nitrate salts of zinc or magnesium used either alone or in conjunction with citric acid. Preferred salts are zinc nitrate and magnesium chloride. A preferred mixed catalyst system is contemplated to contain a molar ratio of about 20:1 to about 5:1 of a metal salt to citric acid.

The hydroxyalkylamine salt may be a primary, secondary or tertiary amine and may possess one, two, or three hydroxyalkyl groups. Usable compounds include halide salts of monoethanolamine, diethanolamine, triethanolamine, 2-amino-2-ethyl-1,3-propandiol, 2-amino-2-methyl-1-propanol, 2-dimethylamino-2-methyl-1-propanol, N-methyldiethanolamine, and tris(hydroxymethyl)aminomethane. In a preferred embodiment the hydroxyalkylamine is used in its hydrochloride form. Preferred hydroxyalkylamines include hydroxyethylamine and triethanolamine. The most preferred hydroxyalkylamine is triethanolamine. This is due to its possession of the maximum number of hydroxyethyl groups, which is responsible for both its low amine odor and high level of reactivity with the crosslinking agent.

In an alternate embodiment the hydroxyalkylamines may be introduced into the formulation in their non-salt form, but are then converted to their respective salts by reaction with the appropriate reagent prior to the addition of the catalyst.

The hydroxyalkyl quaternary ammonium salts envisioned for use in the reaction formulation include both the halide and sulfate salts of said compounds. Among the halide salts the chloride salt is preferred. Among the sulfate salts the dialkyl sulfate salts are preferred, with the dimethyl sulfate salts and diethyl sulfate salts being especially preferred. Examples of useable compounds include (2-hydroxyethyl)trimethylammonium chloride and bis(,2-hydroxyethyl)dimethylammonium chloride.

The sum total amount of the hydroxyalkylamine salt and/or the hydroxyalkyl quaternary ammonium salt used in the formulation is from about 3% to about 15% by weight of the formulation.

The balance of the crosslinking formulation is represented by an aqueous solvent system which may be either water or a mixed system comprising either a water/alcohol mixture or a water/acetone mixture in a volumetric proportional ratio of 99:01 to about 80:20. Useable alcohols include alkanols of 1 to 6 carbons, with ethanol being preferred. The amount of solvent used is from about 10% to about 90% by weight of the formulation, with a preferred amount ranging from about 15% to about 75%.

The processes of instant invention are carried out by first contacting the cellulosic material with the aqueous crosslinking formulation containing a methylolamide crosslinking agent, a catalyst, and one or more of a hydroxyalkylamine salt or a hydroxyalkyl quaternary ammonium salt. This may be done by spraying or immersion of the material in a bath of the crosslinking formulation. After being thoroughly wetted in the treating bath, the cellulosic material may be passed between squeeze rolls to remove excess liquid. Alternatively, low wet pickup techniques of application (sometimes called minimum add-on application) may be employed, such as by kiss roll, foam finishing, loop padding, spraying, printing, or other methods known in the art. The material is then dried at any convenient temperature just sufficient to remove the solvent within the desired amount of time. The material is then cure for about 15 seconds to about 5 minutes at an inversely corresponding temperature range of about 220° C. to about 100° C. Alternatively the above drying step can be omitted, and the material can be flash-cured to remove the solvent at the same time that the crosslinking of the cellulose takes place. If desired, the cured material may subsequently be given a water rinse to remove unreacted reagents and curing catalyst, and may then be redried. The fabrics may then be dyed after curing.

A crucial operation in the inventive process is the treatment of the crosslinked cellulosic material with alkali. In this treatment the crosslinked material is contacted with an alkali solution for a period of time sufficient to cause the desired change in the structure of the crosslinked material. Contact can be by way of immersion, spraying, padding or other suitable means. The contact time of the alkali with the cellulosic material is from about 0.5 minutes to about 20 minutes. The alkali solution is aqueous in nature and is composed of about 5% to about 30% by weight of one or more alkali metal hydroxides or quaternary ammonium hydroxides. Preferred alkali agents include sodium hydroxide, potassium hydroxide and N-Benzyltrimethylammonium hydroxide. Sodium hydroxide is most preferred. After the alkali treatment, the cellulosic material is rinsed with an aqueous acid solution to remove and neutralize any remaining alkali. The fabrics are then optionally dried.

The fabrics can be dyed with acid, direct, and reactive classes of anionic dyes at a pH from about 2 to about 6, with the preferred pH being from about 3 to about 4.5. The dyebath pH can be adjusted to the proper level by adding a sufficient quantity of acetic acid or other suitable acid. Of the classes of dyes listed, unmodified cellulose has very little or no affinity for acid dyes under any pH conditions. Unmodified cellulose has affinity for reactive dyes only when the dyes are fixed to cellulose under alkaline pH conditions. When unmodified cellulose is dyed with these dyes, a salt such as sodium chloride or sodium sulfate, must be added to the dyebath for proper exhaustion of dye into the fiber. In contrast, the modified material of the invention can be dyed effectively without utilizing any salt. However, if desired, from about 1% to about 2% of salt by weight of the dye solution can be used in the dyebath with any of acid, direct or reactive dyes.

The following examples are intended only to further illustrate the invention and are not intended to limit the scope of the invention which is defined by the claims, with all percentages herein disclosed being by weight unless otherwise specified.

Color strength was determined by means of a spectrophotometer and is expressed in terms of K/S values as derived from the Kubelka-Munk equation. Procedures based on the Kubelka-Munk equation are used to measure dye absorption. This procedure utilizes a dilute dye solution to determine the wavelength of maximum dye absorption of a given dyestuff. Reflectance of the dyed fabric is measured at that wavelength. In the Kubelka-Munk equation $$K/S = \frac{(1-R)^2}{2R}$$

where:

K=light absorption coefficient,

S=light scattering coefficient, and

R=reflectance or reflection factor.

The K/S value is directly related to the color intensity of the fabric. Once reflectance, R, is determined, K/S can readily be calculated. The higher the K/S value, the greater the color depth and hence the greater the dye absorption in dyeing. For example, the K/S value of mercerized cotton control is greater than that of untreated cotton control, reflecting the greater dyeability of cotton fabrics after mercerization.

K/S values are also used to approximate the color strength of a sample relative to that of cellulosic control, which is simultaneously dyed in the same dye bath. Thus, the K/S of a sample divided by the K/S of untreated cellulose control (either mercerized or unmercerized) times 100 equals the percent dye absorbed relative to the untreated cotton control. Durable press ratings (in Table III) were determined according to AATCC test method 124-1984. The rating scale is from 1 to 5, with the higher value depicting a nearly wrinkle-free material. Conditioned wrinkle recovery angle (in Tables I and II) was measured according to AATCC test method 66-1984.

EXAMPLE 1

Cotton fabric was impregnated to about 90% wet pickup by padding with a solution containing 12% dimethyloldihydroxyethyleneurea (DMDHEU), 6% triethanolamine hydrochloride (TEA), 3.6% magnesium chloride hexahydrate, and 0.1% nonionic wetting agent. The padded fabric was dried for 7 minutes at 60° C., cured for 3 minutes at 160° C., and washed to remove unreacted substances. Samples of finished fabric were then post-treated with 20% aqueous sodium hydroxide for the times listed in Table I. Each sample was rinsed with water, neutralized with acetic acid, and then dyed with a solution containing C.I. Reactive Blue 3 (a monochlorotriazine dye) in an amount equal to 3% based on the weight of the sample at pH 3 for 60 minutes at 95° C. The data in Table I show that dyeability of crosslinked cotton containing triethanolamine (TEA) was substantially improved by alkali treatment. In addition, the fabrics retained a high degree of resiliency even after the alkali treatment, as indicated by the conditioned wrinkle recovery angles.

TABLE I

| Example | Alkali treatment time (min) | Wrinkle recovery angle (W + F) | Color strength (K/S value) |
|---|---|---|---|
| 1A | 0.0 | 291 | 11.0 |
| 1B | 0.5 | 291 | 29.0 |
| 1C | 1.0 | 283 | 31.1 |
| 1D | 2.0 | 276 | 33.3 |
| 1E | 4.0 | 252 | 35.5 |
| 1F | 8.0 | 253 | 36.6 |

EXAMPLE 2

The procedures of Example 1 were repeated except that the crosslinking solution contained 8% DMDHEU, 6% TEA, 2.4% magnesium chloride hexahydrate, and 0.1% nonionic wetting agent. The results in Table II are similar to those in Table I.

TABLE II

| Example | Alkali treatment time (min) | Wrinkle recovery angle (W + F) | Color strength (K/S value) |
|---|---|---|---|
| 2A | 0.0 | 281 | 11.3 |
| 2B | 0.5 | 271 | 34.7 |
| 2C | 1.0 | 239 | 35.5 |
| 2D | 2.0 | 227 | 36.0 |
| 2E | 4.0 | 226 | 35.2 |
| 2F | 8.0 | 210 | 36.9 |

EXAMPLE 3

The procedures of Example 1 were repeated except that the crosslinking solution contained 6% DMDHEU, 6% TEA, 1.8% magnesium chloride hexahydrate, and 0.1% nonionic wetting agent. The K/S values in Table III, compared with those in Tables I and II, show that the lower concentration of crosslinking agent in this example did not cause a reduction in color strength. However, the fabric of this example had less resiliency than those of the preceding examples.

TABLE III

| Example | Alkali treatment time (min) | Durable press rating | Color strength (K/S value) |
|---|---|---|---|
| 3A | 0.0 | 3.5 | 15.3 |
| 3B | 0.5 | 3.0 | 35.5 |
| 3C | 1.0 | 2.5 | 35.0 |
| 3D | 2.0 | 2.0 | 36.3 |
| 3E | 4.0 | 1.5 | 35.2 |
| 3F | 8.0 | 1.5 | 36.6 |

EXAMPLE 4

The procedures of Example 1 were repeated except that C.I. Direct Red 80 (molecular weight 1240) was substituted for C.I. Reactive Blue 3. The data in Table IV show that with a high-molecular-weight anionic dye, alkali treatment effectively increased color strength over that of the control sample (4A) which was not treated with alkali.

TABLE IV

| Example | Alkali treatment time (min) | Color strength (K/S value) |
|---|---|---|
| 4A | 0.0 | 9.8 |
| 4B | 0.5 | 13.9 |
| 4C | 1.0 | 15.1 |
| 4D | 2.0 | 17.1 |
| 4E | 4.0 | 17.1 |
| 4F | 8.0 | 19.0 |

EXAMPLE 5

The procedures of Example 1 were repeated except that an acid dye, C.I. Acid Red 114 (molecular weight 820), was substituted for C.I. Reactive Blue 3. The data in Table V show that with a relatively high-molecular-weight acid dye, alkali treatment effectively increased color strength over that of the control sample (5A) which was not treated with alkali.

TABLE V

| Example | Alkali treatment time (min) | Color strength (K/S value) |
|---|---|---|
| 5A | 0.0 | 6.8 |
| 5B | 0.5 | 20.3 |
| 5C | 1.0 | 21.5 |
| 5D | 2.0 | 23.8 |
| 5E | 4.0 | 27.9 |
| 5F | 8.0 | 28.3 |

EXAMPLE 6

The procedures of Example 3 were repeated except that, as in Example 5, C.I. Acid Red 114 was substituted for C.I. Reactive Blue 3. The data in Table VI show that color strength of alkali-treated cotton was substantially greater than that of the control sample (6A) which was not treated with alkali. Thus, the alkali treatment was still effective on fabric finished with only 6% crosslinking agent. Furthermore, the data demonstrate that the alkali did not strip the finishing treatment from the fabric because, if the TEA had been removed, the fabric would have had no affinity for the acid dye.

TABLE VI

| Example | Alkali treatment time (min) | Color strength (K/S value) |
|---|---|---|
| 6A | 0.0 | 11.9 |
| 6B | 0.5 | 26.7 |
| 6C | 1.0 | 26.3 |
| 6D | 2.0 | 27.3 |
| 6E | 4.0 | 27.1 |
| 6F | 8.0 | 28.8 |

EXAMPLE 7

The procedures of Example 3 were repeated except that all the post-treatments with alkali were for a period of 5 minutes, the dye was present at the concentrations listed in Table VII, and control samples were prepared without alkali treatment. The data in Table VII show that exceptionally high color strength was obtained on the alkali-treated material even at relatively low dye concentrations. Furthermore, color strength of the alkali-treated material was greater even at the lowest dye concentration than the color strength for the highest dye concentration of the samples that were not alkali-treated.

TABLE VII

| | | K/S value | |
|---|---|---|---|
| Example | % Dye | Without alkali | Alkali-treated |
| 7A | 0.5 | 6.5 | 19.2 |
| 7B | 1.0 | 8.6 | 29.5 |
| 7C | 1.5 | 10.8 | 32.6 |
| 7D | 2.0 | 15.0 | 35.2 |

EXAMPLE 8

The procedures of Example 3 were repeated except that post-treatments were with the concentrations of sodium hydroxide listed in Table VIII, and all post-treatments were for 15 minutes. The results in Table VIII show that a high level of color strength was achieved even with low concentrations of alkali. Crosslinked cotton finished without TEA and then alkali treated had K/S values of less than 1, showing that alkali treatment was effective only on finished material that contained the reactive nitrogen-based additive. Wrinkle recovery angles of the samples ranged from 269°-214° (W+F).

TABLE VIII

| Example | % Alkali | K/S value |
|---|---|---|
| 8A | 0 | 11.0 |
| 8B | 5 | 24.8 |
| 8C | 10 | 29.1 |
| 8D | 15 | 32.8 |
| 8E | 20 | 36.6 |

EXAMPLE 9

The procedures of Example 3 were repeated except that TEA was present at the concentrations listed in Table IX, all the post-treatments with alkali were for a period of 5 minutes, and control samples were prepared without alkali treatment. The results in Table IX show that color strength was influenced by the concentration of TEA used in finishing and, therefore, reflects the amount of this agent bound in the crosslinked fabric. Color strength of alkali-treated material was superior to that of samples that were not alkali-treated.

TABLE IX

| Example | % TEA | K/S value Without alkali | Alkali-treated |
|---|---|---|---|
| 9A | 0 | 0.6 | 1.7 |
| 9B | 0.5 | 3.1 | 9.9 |
| 9C | 1.0 | 5.0 | 16.4 |
| 9D | 2.0 | 10.7 | 24.4 |
| 9E | 4.0 | 16.6 | 31.7 |
| 9F | 6.0 | 20.5 | 35.2 |

EXAMPLE 10

The procedures of Example 9 were repeated except that C.I. Direct Blue 78 was substituted for C.I. Reactive Blue 3. The data in Table X show that, with a high-molecular-weight direct dye (molecular weight > 1100), color strength of the alkali-treated material was substantially better than that of the cotton that was not alkali-treated. In fact, color strength of the alkali-treated material is greater at a much lower concentration of amine than the color strength of the samples without alkali at higher concentrations of amine.

TABLE X

| Example | % TEA | K/S value Without alkali | Alkali-treated |
|---|---|---|---|
| 10A | 0 | 3.3 | 13.1 |
| 10B | 0.5 | 4.6 | 16.6 |
| 10C | 1.0 | 5.6 | 17.7 |
| 10D | 2.0 | 7.5 | 20.8 |
| 10E | 4.0 | 10.0 | 28.1 |
| 10F | 6.0 | 12.8 | 29.0 |

EXAMPLE 11

The procedures of Example 7 were repeated except that the amount of dye was 3% based on the weight of the sample for all samples, and dyeing was performed with C.I. Reactive Blue 193 (a difluorochloroprimidine dye) and with C.I. Reactive Red 40 (a dichloroquinoxaline dye) instead of C.I. Reactive Blue 3. The results in Table XI show that exceptionally high color strength was obtained on the alkali-treated material with both of these dyes, which are chemically different from the C.I. Reactive Blue 3. Under these dyeing conditions, even unmodified cotton has little or no affinity for any of these dyestuffs.

TABLE XI

| Example | Dye | K/S value Without alkali | Alkali-treated |
|---|---|---|---|
| 11A | C.I. Reactive Blue 193 | 16.7 | 33.7 |
| 11B | C.I. Reactive Red 40 | 7.1 | 20.9 |

It is understood that the foregoing detailed description is given merely by way of illustration and that modification and variations may be made therein without departing from the spirit and scope of the invention.

We claim:

1. A modified crosslinked cellulosic reaction product consisting of a crosslinked cellulosic reaction product comprising: a cellulosic substrate; a methylolamide crosslinking agent bound to said cellulose substrate, wherein said methylolamide crosslinking agent is supplied in a formulation concentration of about 3% to about 15% by weight; and one or more of a hydroxyalkylamine or a hydroxyalkyl quaternary ammonium compound chemically bound to said methylolamide crosslinking agent; wherein said crosslinked cellulosic reaction product which has been cured at a temperature range of about 100° C. to about 220° C. has been subsequently modified by contact for about 0.5 minutes to about 20 minutes with an aqueous solution containing an alkali agent is selected from the group consisting of alkali metal hydroxides and quaternary ammonium hydroxides in an amount of about 5% to about 30% by weight so as to expand the cellulosic fiber structure and make the material more amenable to anionic dyeing.

2. The crosslinked cellulosic reaction product of claim 1 wherein said methylolamide crosslinking agent is selected from the group consisting of, methylolated ureas, cyclic ureas, urons, triazones, carbamates, triazines and alkylated and hydroxyalkylated derivatives thereof.

3. The crosslinked cellulosic reaction product of claim 2 wherein said methylolamide crosslinking agent is selected from the group consisting of dimethyloldihydroxyethyleneurea, dimethylolurea, partially methylolated urea, methylated urea-formaldehyde, dimethylolethyleneurea, dimethylol propyleneurea, trimethylol acetyleneurea, tetramethylol acetyleneurea, bis(methoxymethyl)uron, dimethylol methyl carbamate, dimethylol n-propyl carbamate, dimethylol isopropyl carbamate, trimethylolated melamine, tris(methoxymethyl) melamine, and hexa(methoxymethyl)melamine.

4. The crosslinked cellulosic reaction product of claim 1 wherein said alkali agent is sodium hydroxide, potassium hydroxide, N-Benzyltrimethylammonium hydroxide or mixtures thereof.

5. The crosslinked cellulosic reaction product of claim 1 wherein said hydroxyalkylamine is a primary, secondary, or tertiary hydroxyalkylamine; or mixtures thereof.

6. The crosslinked cellulosic reaction product of claim 5 wherein said hydroxyalkylamine is selected from the group consisting of monoethanolamine, diethanolamine, triethanolamine, 2-amino-2-ethyl-1,3-propandiol, 2-amino-2-methyl-1-propanol, 2-dimethylamino-2-methyl-1-propanol, N-methyldiethanolamine, and tris(hydroxymethyl) aminomethane, or mixtures thereof.

7. The crosslinked cellulosic reaction product of claim 5 wherein said hydroxyalkylamine is hydroxymethylamine, hydroxyethylamine, triethanolamine or mixtures thereof.

8. The crosslinked cellulosic reaction product of claim 1 wherein said hydroxyalkyl quaternary ammonium compound is one of (2-hydroxyethyl)trimethylammonium chloride, bis(2-hydroxyethyl)dimethylammonium chloride or mixtures thereof.

9. The crosslinked cellulosic reaction product of claim 1 having an anionic dye bound thereto.

10. The crosslinked cellulosic reaction product of claim 9 wherein said anionic dye has a molecular weight of from about 800 to about 1,400.

11. The crosslinked cellulosic reaction product of claim 9 wherein said anionic dye is an acid dye, a direct dye or a reactive dye.

12. The crosslinked cellulosic reaction product of claim 1 wherein the cellulose component of said cellulosic substrate is selected from the group consisting of cotton, rayon, jute, ramie and flax.

13. The crosslinked cellulosic reaction product of claim 1 wherein said cellulosic substrate is in a form selected from the group consisting of fibers, threads, linters, roving, fabrics, yarns, slivers and paper.

14. A process for subsequently modifying a crosslinked cellulosic material comprising contacting a cellulosic material which, has been crosslinked with a methylolamide crosslinking agent, present in a crosslinking formulation concentration of about 3% to about 15% by weight, in the presence of a salt of either a hydroxyalkylamine or a quaternary ammonium compound and subsequently cured at a temperature range of about 100° C. to about 220° C., with an aqueous alkali agent selected from the group consisting of alkali metal hydroxides and quaternary ammonium hydroxides and present in the solution in an amount of about 5% to about 30% by weight of said solution for a period of time sufficient to expand the cellulosic fiber structure and make the material more amenable to anionic dyeing.

15. The process of claim 14 wherein said alkali agent is sodium hydroxide, potassium hydroxide, N-Benzyltrimethylammonium hydroxide or mixtures thereof.

16. The process of claim 14 wherein the contact time is from about 0.5 minutes to about 20 minutes.

17. The process of claim 14 further comprising the rinsing and neutralization of excess alkali agent from said modified crosslinked cellulosic material.

18. The process of claim 14 wherein said methylolamide crosslinking agent is selected from the group consisting of methylolated ureas, cyclic ureas, urons, triazones, carbamates, triazines and alkylated and hydroxyalkylated derivatives thereof.

19. The process of claim 18 wherein said methylolamide crosslinking agent is selected from the group consisting of dimethyloldihydroxyethyleneurea, dimethylolurea, partially methylolated urea, methylated urea-formaldehyde, dimethylolethyleneurea, dimethylol propyleneurea, trimethylol acetyleneurea, tetramethylol acetyleneurea, bis(methoxymethyl)uron, dimethylol methyl carbamate, dimethylol n-propyl carbamate, dimethylol isopropyl carbamate, trimethylolated melamine, tris(methoxymethyl)melamine, and hexa(methoxymethyl) melamine.

20. The process of claim 14 wherein said salt of a hydroxyalkylamine compound is a halogen salt and said hydroxyalkyl quaternary ammonium salt is a halogen or sulfate salt.

21. The process of claim 14 wherein the hydroxyalkylamine component of said salt of a hydroxyalkylamine is a primary, secondary or tertiary hydroxyalkylamine; or mixtures thereof.

22. The process of claim 21 wherein said hydroxyalkylamine component is selected from the group consisting of monoethanolamine, diethanolamine, triethanolamine, 2-amino-2-ethyl-1,3-propandiol, 2-amino-2-methyl-1-propanol, 2-dimethylamino-2-methyl-1-propanol, N-methyldiethanolamine, and tris(hydroxymethyl) aminomethane, or mixtures thereof.

23. The process of claim 14 wherein said hydroxyalkyl quaternary ammonium salt is bis(2-hydroxyethyl)-dimethylammonium chloride, (2-hydroxyethyl)trimethylammonium chloride, or mixtures thereof.

24. The process of claim 14 wherein said catalyst is a halide or nitrate salt of zinc or magnesium either alone or in combination with citric acid.

25. The process of claim 24 wherein said catalyst is magnesium chloride either alone or in combination with citric acid.

26. The process of claim 14 wherein the cellulose component of said cellulosic material is selected from the group consisting of cotton, rayon, jute, ramie and flax.

27. The process of claim 14 wherein said cellulosic material is in a form selected from the group consisting of fibers, threads, linters, roving, fabrics, yarns, slivers and paper.

28. The process of claim 17 further including a step of dyeing the modified crosslinked cellulosic material with an anionic dye.

29. The process of claim 28 wherein said anionic dye has a molecular weight of from about 800 to about 1,400.

* * * * *